US009263009B2

(12) United States Patent
Lee

(10) Patent No.: US 9,263,009 B2
(45) Date of Patent: Feb. 16, 2016

(54) SOUND INSULATION ELECTRONIC PAD FOR BASS DRUM OF JAZZ DRUM SET

(71) Applicant: Chun-Ming Lee, Taipei (TW)

(72) Inventor: Chun-Ming Lee, Taipei (TW)

( * ) Notice: Subject to any disclaimer, the term of this patent is extended or adjusted under 35 U.S.C. 154(b) by 0 days.

(21) Appl. No.: 14/624,315

(22) Filed: Feb. 17, 2015

(65) Prior Publication Data

US 2015/0235635 A1 Aug. 20, 2015

(30) Foreign Application Priority Data

Feb. 20, 2014 (TW) ..... 103202942 U

(51) Int. Cl.

| | |
|---|---|
| ***G10F 1/08*** | (2006.01) |
| ***G10H 3/00*** | (2006.01) |
| ***G10D 13/02*** | (2006.01) |
| ***G10D 13/00*** | (2006.01) |

(52) U.S. Cl.

CPC ..... *G10D 13/024* (2013.01); *G10D 13/006* (2013.01); *G10D 13/022* (2013.01); *G10D 13/029* (2013.01)

(58) Field of Classification Search

CPC ..... G10H 3/146; G10H 2230/271; G10H 2230/281; G10H 1/32; G10H 2250/435; G10H 2230/291; G10H 2230/305; G10H 2220/046; G10H 2230/275; G10H 2230/285

See application file for complete search history.

(56) References Cited

U.S. PATENT DOCUMENTS

| | | | | |
|---|---|---|---|---|
| 2006/0000341 | A1* | 1/2006 | Steele | G10D 13/006 84/422.1 |
| 2006/0207408 | A1* | 9/2006 | Steele | G10D 13/006 84/422.1 |
| 2008/0072737 | A1* | 3/2008 | Steele | G10D 13/006 84/422.1 |
| 2012/0006178 | A1* | 1/2012 | Steele | G10D 13/026 84/421 |
| 2012/0266737 | A1* | 10/2012 | Mori | G10D 13/006 84/421 |
| 2014/0260919 | A1* | 9/2014 | Kanayama | G10H 3/146 84/730 |
| 2014/0260920 | A1* | 9/2014 | Kanayama | G10H 3/146 84/730 |
| 2014/0260921 | A1* | 9/2014 | Kanayama | G10D 13/026 84/730 |
| 2015/0235635 | A1* | 8/2015 | Lee | G10D 13/006 84/723 |

* cited by examiner

*Primary Examiner* — Marlon Fletcher

(74) *Attorney, Agent, or Firm* — Muncy, Geissler, Olds & Lowe, P.C.

(57) ABSTRACT

The present disclosure illustrates a sound insulation electronic pad for a bass drum of a jazz drum set. The electronic pad is assembled with a drum frame of the bass drum of the jazz drum set by a support structure, and located between a drumhead of the bass drum and a drum pedal. The electronic pad does not contact with the drumhead of the bass drum. When the electronic pad is knocked by the drumstick and the drumhead of the bass drum is not knocked by the drumstick, the electronic pad and an external trigger module simulate an electronic drum sound of the bass drum and output the electronic drum sound via an output device such as earphones or a loudspeaker. Therefore, the electronic pad of the present disclosure can be used to remodel the bass drum of the jazz drum set as an electronic drum.

17 Claims, 5 Drawing Sheets

SOUND INSULATION ELECTRONIC PAD FOR BASS DRUM OF JAZZ DRUM SET

CROSS-REFERENCE TO RELATED APPLICATION

This application claims the benefit of Taiwan Patent Application No. 103202942 filed on Feb. 20, 2014, the disclosure of which is incorporated herein in its entirety by reference, in the Taiwan Intellectual Property Office.

BACKGROUND OF THE INVENTION

1. Field of the Invention

The present disclosure relates to a bass drum of a jazz drum set, more particularly to a sound insulation electronic pad able to be assembled with the bass drum. The electronic pad is located between a drumhead of the bass drum and the drum pedal, and a drumstick of the drum pedal can knock on the electronic pad but not directly knock the bass drum, whereby the bass drum can be remodeled as an electronic drum.

2. Description of the Related Art

A jazz drum set, also known as drum kit, is set of the combination of hand hit instrument and foot hit instrument having with different types and different tones, and can be applied to a variety of music types. Electronic drum is a percussion instrument using electronic synthesizer to produce drumbeats, and includes two parts of the electronic synthesizers and the striking region portion. The electronic drum looks like the drums in appearance, but has relatively small size and drumhead.

Based on the diversification of types of music and performance, many drummers must be familiar with jazz drum set and electronic drums both. However, while both of the jazz drum and the electronic drum are placed in the performance occasions and practice environments, it is a very space-consuming. In addition, the positions and heights of the large jazz drum, medium jazz drum, snare jazz drum and cymbal are different from the electronic drum, so the drummer who is familiar to the jazz drum already also must spend time to re-adapt to the positions and heights of the electronic drums for re-training feel. Therefore, if the jazz drum set can be remodeled into the electronic drums directly, the problem of re-adaption for drummers can be solved and prevent the space from being occupied by two sets of drums.

SUMMARY OF THE INVENTION

The problem to be solved in this disclosure is how to convert a jazz drum into an electronic drum, more particularly to remodel a bass drum of a jazz drum set as an electronic drum.

An object of the present disclosure is to provide a sound insulation electronic pad for a bass drum of a jazz drum set to solve the aforesaid problem. The electronic pad is assembled with a drum frame of the bass drum by a support structure, and located between a drumhead of the bass drum and a drum pedal, but the electronic pad does not contact with the drumhead the bass drum. When the electronic pad is knocked by a drumstick of the drum pedal but the drumhead of the bass drum is not knocked by the drumstick, the electronic pad and an external trigger module coupled with the electronic pad can simulate an electronic drum sound of the bass drum and output the electronic drum sound via an output device such as earphones or a loudspeaker. Therefore, the electronic pad can be used to remodel the bass drum as an electronic drum.

Moreover, the support structure can be fastened with the drum frame of the bass drum by a drum frame engaging member, and a rear part of the support structure is fastened with a drum pedal by a drum pedal engaging member, whereby the drum frame of the bass drum, the support structure of the electronic pad, and the drum pedal can be fastened in series with each other.

Moreover, the height of the electronic pad on the support structure is adjustable.

Moreover, the electronic pad is provided with a decoration disposed at a periphery thereof, and the decoration can be a lighting unit. The decoration represents a decorating effect while the electronic pad is knocked by the drumstick.

Moreover, the bass drum is provided with drumhead silencer pads respectively attached on front and back drumheads to prevent the drumhead of the bass drum from conducting resonance due to vibration.

The present disclosure has at least one of the following effects:

First, the electronic pad can be assembled with the drum frame of the bass drum, so that the drumhead of the bass drum can be replaced by the electronic pad, and the bass drum of the jazz drum is remodeled as an electronic drum correspondingly.

Secondly, the electronic pad can be assembled with the drum frame of the bass drum, so it is very convenient and quick for user to assemble, replace, and disassemble the electronic pad.

Thirdly, the drum frame of the bass drum, the support frame of the electronic pad, and the base of the drum pedal are fastened in series with each other, so their assembly stability can be improved.

Fourthly, the height of the electronic pad on the support frame is adjustable to match with various bass drums with different diameter sizes such as 18, 20, 22, 24, or 26 inches.

Fifthly, the decoration represents a decorating effect while the electronic pad is knocked by the drumstick, so as to improve a visible effect of the electronic pad.

Sixthly, the drumhead silencer pads attached on the front and back drumheads of the bass drum can limit the resonant vibration, to efficiently eliminate 95% or more of the resonant vibration on the drumhead of the bass drum, so that the noise caused by the resonance of the elimination can be inhibited.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
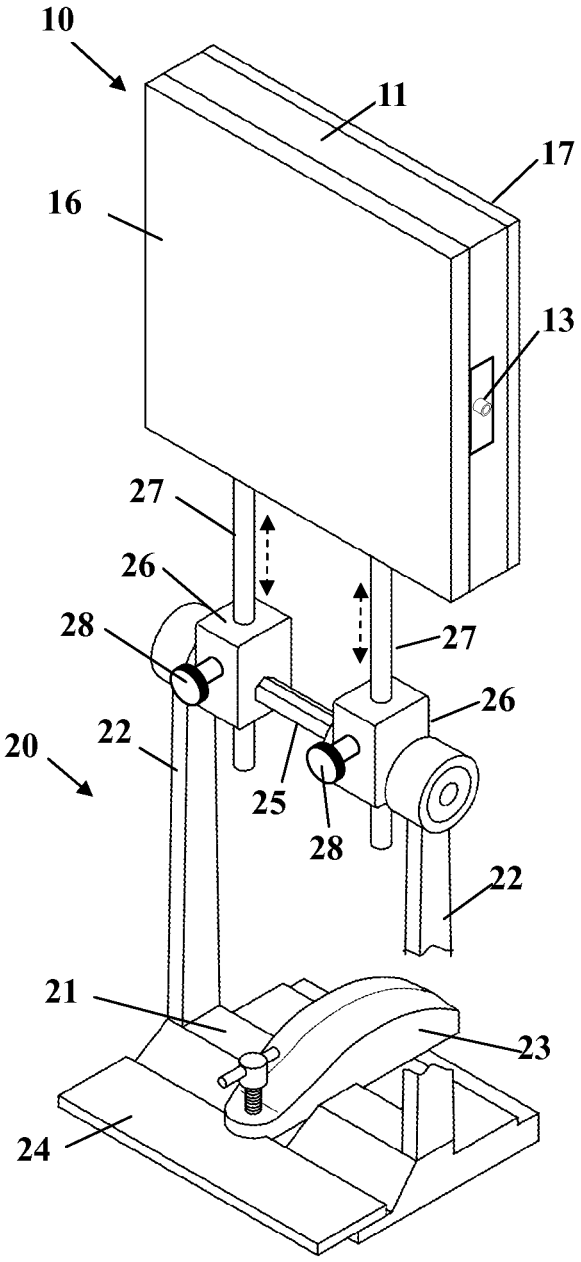
FIG. 1 is a perspective appearance view of an electronic pad and a support structure thereof in accordance with the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions, sizes, ratios, amounts of deformation or movement of various elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

Figure 2:
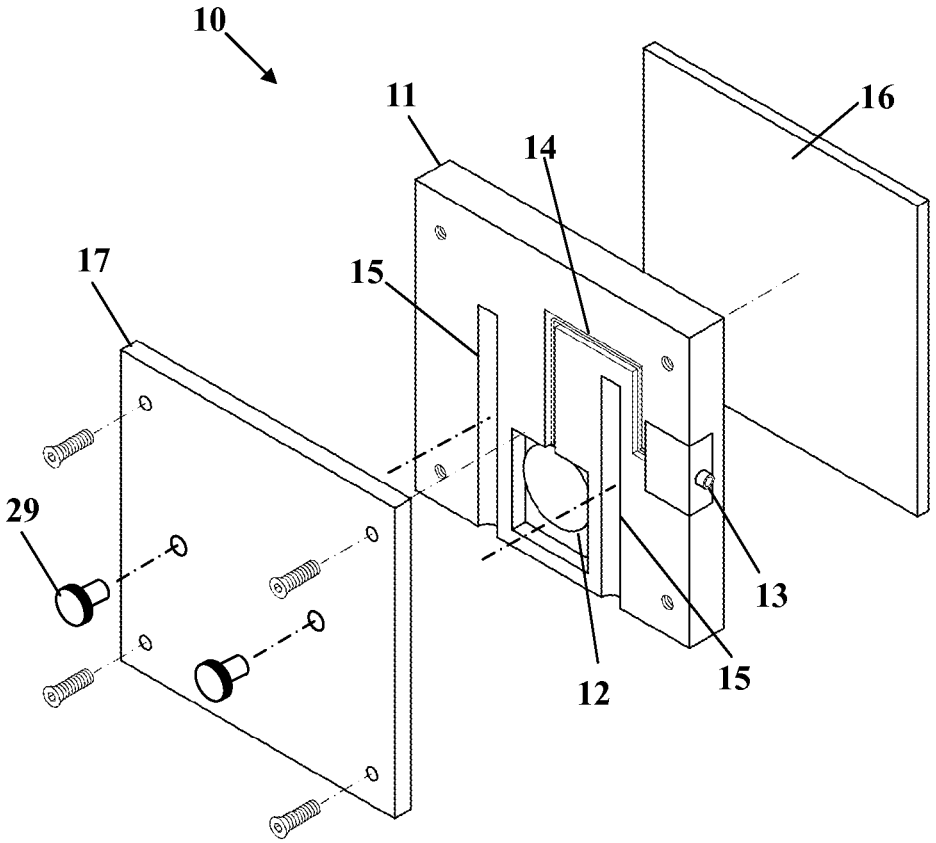
FIG. 2 is an exploded view of the electronic pad in accordance with the present disclosure.
Figure 3:
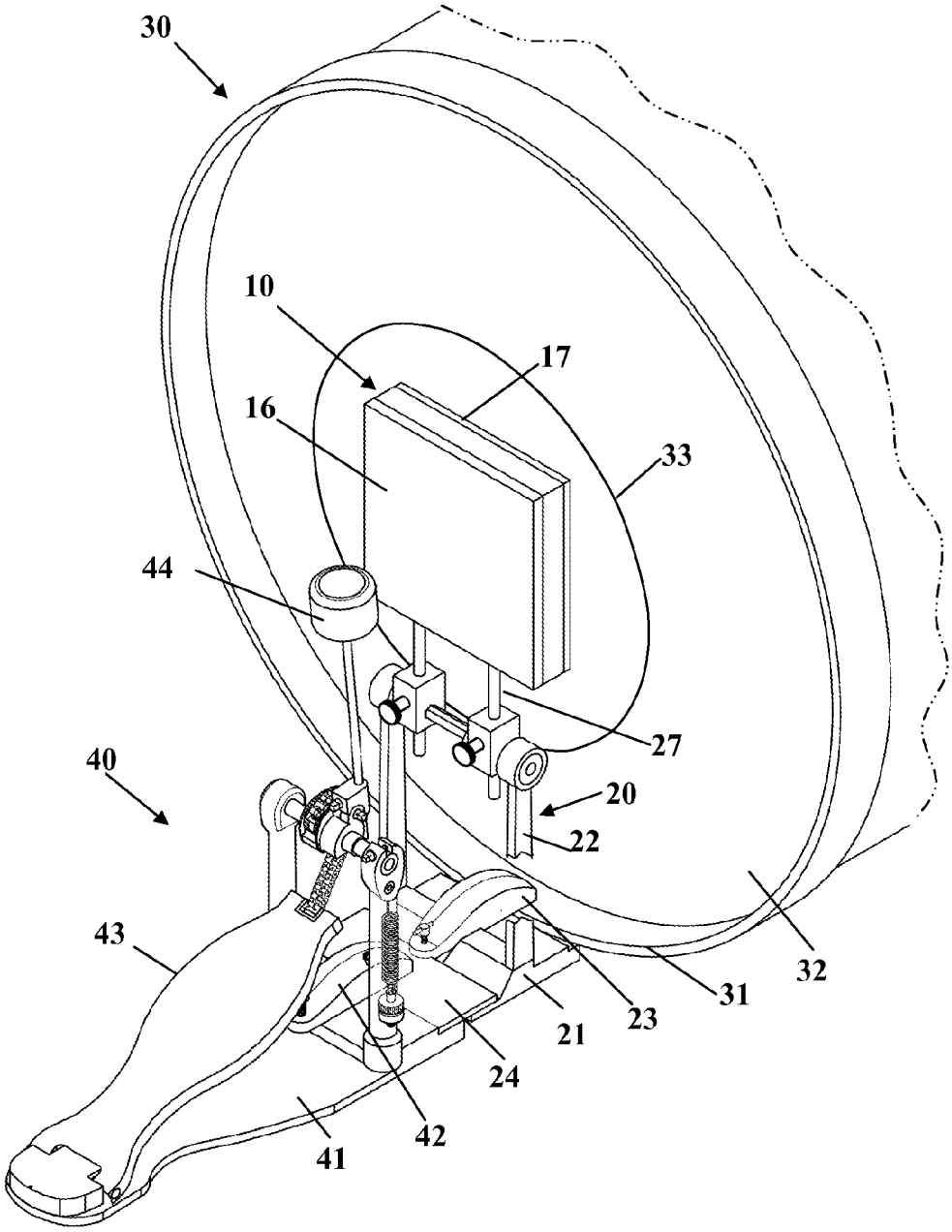
FIG. 3 is a perspective view of the support structure connected with the drum frame and the drum pedal of a bass drum, in accordance with the present disclosure.

Please refer to FIG. 1, FIG. 2 and FIG. 3. A sound insulation electronic pad for a bass drum of a jazz drum set includes an electronic pad 10 and a support structure 20.

The electronic pad 10 includes a baseboard 11, an electronic sensor 12 embedded in a back part thereof, a socket 13 embedded in the back part thereof, a transmission line 14 embedded in the back part thereof and electrically connected to the socket 13 and the electronic sensor 12, a pair of rod-like grooves 15 disposed in the baseboard 11, a knock pad 16 fastened at a front part of the baseboard 11, and a packaging board 17 fastened at the back part of the baseboard 11. An outline of the baseboard 11 can be in various geometrical shapes, and the material of the baseboard 11 can be, but not limited thereto, wood, silica gel, rubber or metal. An outline of the knock pad 16 can be in various geometrical shapes, and the material of the baseboard 11 can be, but not limited thereto, wood, silica gel, or rubber.

The support structure 20 includes a base 21 which can be stably placed on the ground, a pair of stand columns 22 disposed at left and right sides of the base 21, a drum frame engaging member 23 disposed at a front part of the base 21, a drum pedal engaging member 24 disposed at a back part of the base 21, a cross rod 25 linked with the two stand columns 22, a pair of modules 26 disposed on the cross rod 25, support rods 27 vertically passed through the modules respectively and adjustable in height, and two positioning components 29 inserted into a thickness side of the packaging board 17 and applying radial push force to an upper portion of the second support rod 27. The upper portion of each of support rods 27 is inserted through a rod-like groove 15 of the electronic pad 10.

Connection relationships with limited relative rotation are built between the cross rod 25 and the stand column 22, and between the cross rod 25 and the module 26, so as to ensure stability of connection between the cross rod 25 and the module 26.

The support rod 27 is positioned within the module 26 by a packing member 28 which is transverse screwed into the module 26; in the other word, while the packing member 28 is loosed, the support rod 27 can be moved up and down to adjust the height of the electronic pad 10 in the support structure 20, so that the electronic pad 10 can be fitted with various bass drums with different diameter sizes such as 18, 20, 22, 24 and 26 inches. A depth of the support rod 27 being passed through the rod-like groove 15 can be used for adjusting a height of the electronic pad 10, the positioning component 29 can be used to pack and position the support rod 27 within the rod-like groove 15, whereby the electronic pad 10 can be kept at the adjusted height, and the positioning component 29 can be used to stably engage the electronic pad 10 and the support rod 27 with each other and eliminate the clearance therebetween. Therefore, the electronic pad 10 can be prevented from colliding with the support rod 27 to generate noise while being knocked.

Figure 4:
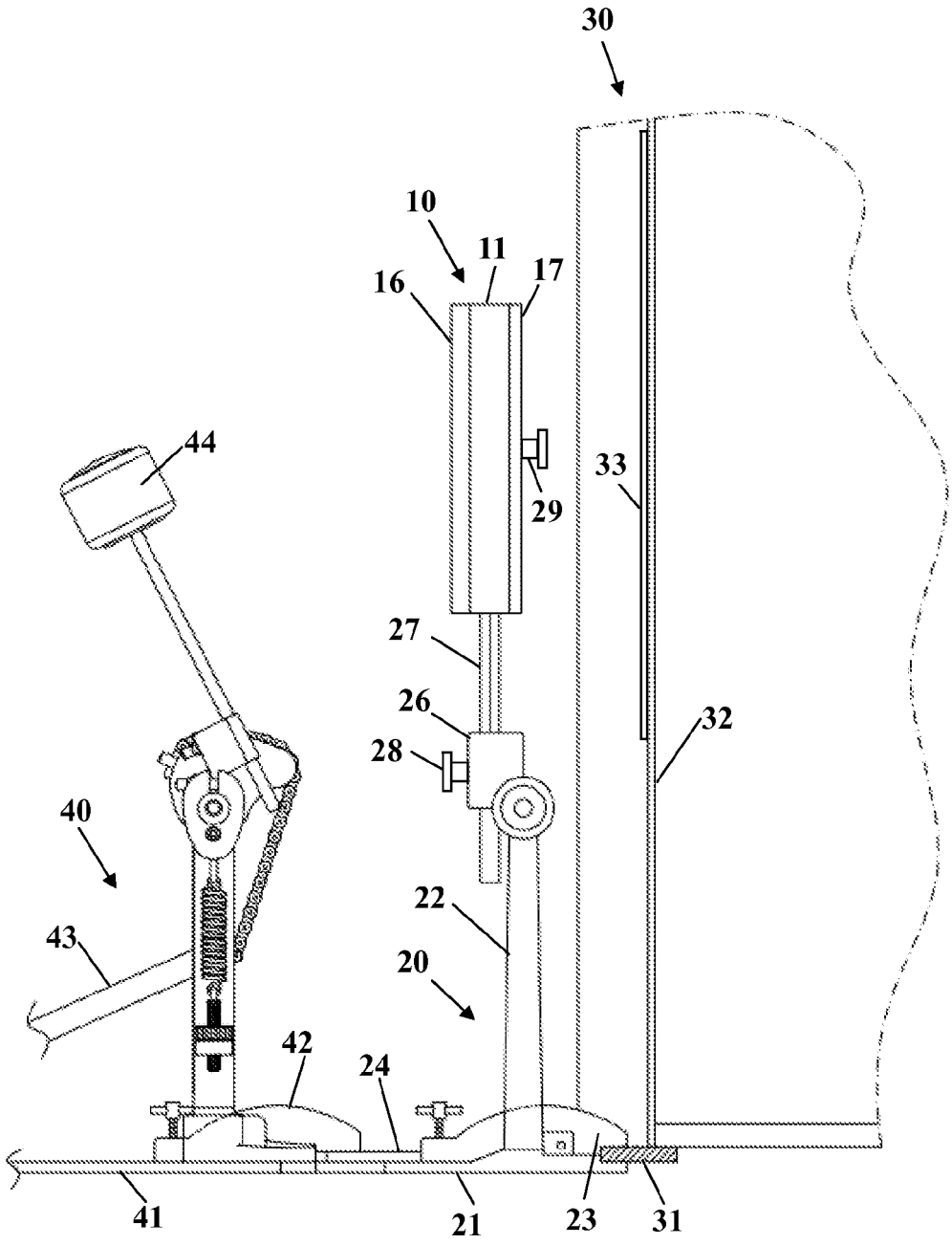
FIG. 4 is a lateral schematic view of the support structure connected with the drum frame and the drum pedal of a bass drum, in accordance with the present disclosure.

As shown in FIG. 3 and FIG. 4, the drum frame engaging member 23 can be a clamping structure to clamp the drum frame 31 of the bass drum 30. The drum frame engaging member 23 can also be a locking structure (not shown in FIGs) to joint with the drum frame 31 of the bass drum 30 via the locking element. The drum frame engaging member 23 can also be a buckle structure (not shown in FIGs) to buckle and fasten with the drum frame 31 of the bass drum 30.

The drum pedal engaging member 24 can be in different shapes according to form of the drum pedal 40. In the embodiment of the present disclosure, the drum pedal engaging member 24 is a plate structure. The drum pedal 40 has a traditional structure mainly including a base 41, an engaging member 42 disposed at a front end of the base 41, a pedal 43 disposed at the base 41 and provided with a front end movable up and down, and a drumstick 44 controlled by the pedal 43 to reciprocate and swing. The engaging member 42 is originally used to engage and fasten with the drum frame 31 of the bass drum 30. The engaging member 42 can be one of the clamping structure, the locking structure, and a buckle structure to clamp, lock or buckle the drum pedal engaging member 24.

As shown in FIG. 3 and FIG. 4, the support structure 20 is assembled with the drum frame 31 of the bass drum 30 by the drum frame engaging member 23, the drum pedal 40 is linked with the drum pedal engaging member 24 of the support structure 20 by the engaging member 42, so as to enable the drum frame 31, the support structure 20 and the drum pedal 40 to be fastened in series. The electronic pad 10 is located between the drumhead 32 of the bass drum 30 and the drumstick 44, of the drum pedal 40, the knock pad 16 of the electronic pad 10 is faced toward the drumstick 44, the packaging board 17 is faced toward the drumhead 32 of the bass drum 30 and spaced apart from the drumhead 32 by a distance. When a drummer tramples the pedal 43 of the drum pedal 40 to control the drumstick 44 to knock the knock pad 16 of the electronic pad 10, the electronic sensor 12 can sense a vibration caused by the knocking and generate and transmit a signal to an external trigger module (not shown in FIGs) via the transmission line 14 and the socket 13, and the external trigger module then converts the signal into simulated sound of the bass drum, and the simulated sound is outputted via a sound box or earphones. The electronic pad 10 can be assembled with the drum frame 31 of the bass drum 30 by the support structure 20, so that the drumhead 32 of the bass drum 31 can be replaced by the electronic pad 10, to remold the bass drum of the jazz drum set as the electronic drum. The ways of assembling the electronic pad 10 with the drum frame 31 of the bass drum 30 and assembling the drum pedal 40 with the support structure 20 are very simple and easy, so it is very convenient and quick for the user to remodel the bass drum as the electronic drum or restore the electronic drum to the bass drum.

When the knock pad 16 is knocked by the drumstick 44, the vibration of the electronic pad 10 can be possibly transmitted to the drumhead 32 of the bass drum via air, it causes that the drumhead 32 is vibrated correspondingly to enable the bass drum 30 to generate resonance. In order to prevent the bass drum 30 from conducting the resonant vibration, the drumhead silencer pad 33 can be attached on the front and back drumheads of the bass drum to limit the resonant vibration thereof, so as to efficiently eliminate 95% or more of the resonant vibration on the drumhead of the bass drum. Therefore, noise caused by the resonance of the bass drum can be inhibited.

Figure 5:
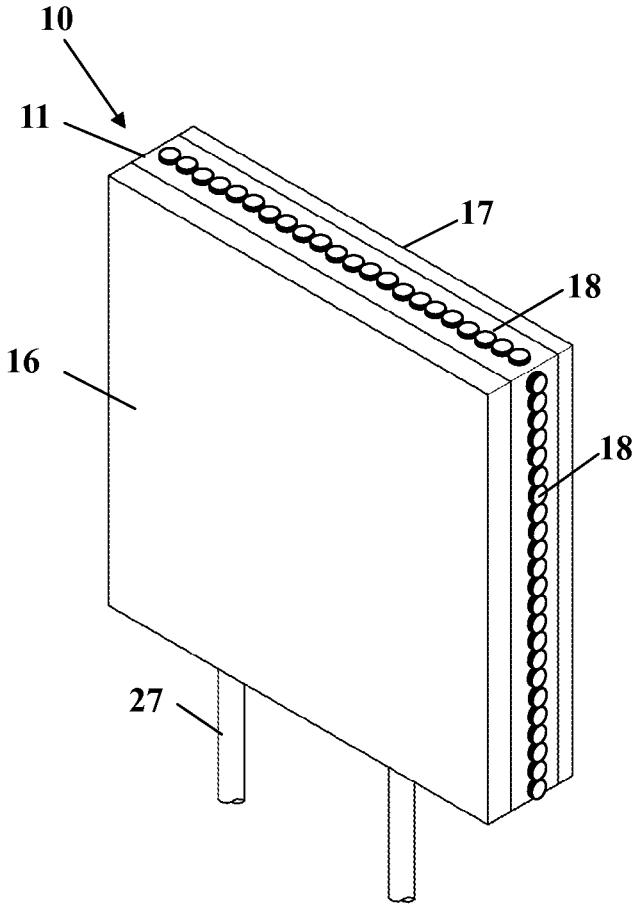
FIG. 5 is an appearance view of the electronic pad with decoration in accordance with the present disclosure.

Please refer to FIG. 5. The electronic pad 10 is provided with a decoration 18 at a peripheral thereof. The decoration 18 can be a lighting unit set or a light strip formed by LEDs. The decoration 18 is coupled with the electronic sensor 12 via a power line and a reactor. When the knock pad 16 is knocked by the drumstick 44, the decoration 18 shows a decorating effect, for example, effects of keeping sparkling, sparkling with, etc., rhythm, so as to increase visible effect.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A sound insulation electronic pad for a bass drum of a jazz drum set, comprising:

an electronic pad, comprising a baseboard, an electronic sensor embedded in a back part of the baseboard, a socket embedded in the back part of the baseboard and coupled to the electronic sensor, a knock pad fastened at a front part of the baseboard, and a packaging board fastened at the back part of the baseboard;

a support structure, comprising a base, a drum frame engaging member disposed at a front part of the base, and a pair of support rods disposed at the base and adjustable up and down, wherein upper sections of the pair of support rods are inserted into the electronic pad and positioned within the electronic pad;

wherein the drum frame engaging member is engaged with the drum frame of the bass drum of the jazz drum set, the packaging board of the electronic pad is faced toward the drumhead of the bass drum and spaced apart from the drumhead of the bass drum by a distance, and the knock pad of the electronic pad corresponds to the drum pedal of the jazz drum set and can be knocked by a drumstick of the drum pedal.

2. The sound insulation electronic pad as defined in claim 1, wherein the support structure further comprises a pair of stand columns disposed at left and right sides of the base, a cross rod linked and fastened between the pair of stand columns, and a pair of modules fastened on the cross rod, and the support rod passed through the module and longitudinal adjustable in height.

3. The sound insulation electronic pad as defined in claim 2, wherein a packing member is screwed into the module and vertical to the support rod to pack and position the support rod.

4. The sound insulation electronic pad as defined in claim 1, wherein the socket and electronic sensors of the electronic pad are electrically connected via a transmission line embedded in back surface of the baseboard.

5. The sound insulation electronic pad as defined in claim 1, wherein material of the baseboard is one of wood, silica gel, rubber and metal.

6. The sound insulation electronic pad as defined in claim 1, wherein material of the knock pad is one of wood, silica gel and rubber.

7. The sound insulation electronic pad as defined in claim 1, wherein the baseboard of the electronic pad is provided with a pair of rod-like grooves therein, and an upper section of the support rod is passed through the rod-like groove and positioned in the rod-like groove.

8. The sound insulation electronic pad as defined in claim 7, further comprising two positioning components passed through a thickness side of the packaging board and configured for applying radial push force on upper sections of the two support rods.

9. The sound insulation electronic pad as defined in claim 1, wherein the drum frame engaging member comprises a clamping structure configured for clamping the drum frame of the bass drum.

10. The sound insulation electronic pad as defined in claim 1, wherein the drum frame engaging member comprises a locking structure configured for locking the drum frame of the bass drum.

11. The sound insulation electronic pad as defined in claim 1, wherein the drum frame engaging member comprises a buckle structure configured for buckling the drum frame of the bass drum.

12. The sound insulation electronic pad as defined in claim 1, wherein the support structure is provided with a drum pedal engaging member disposed at a back part of the base thereof for linking with a base of the drum pedal.

13. The sound insulation electronic pad as defined in claim 11, wherein the drum pedal engaging member is a plate structure.

14. The sound insulation electronic pad as defined in claim 1, wherein the bass drum is provided with drumhead silencer pads respectively attached at front and back drumheads thereof to restrict the vibration of the bass drum.

15. The sound insulation electronic pad as defined in claim 1, wherein the electronic pad is provided with a decoration at a peripheral thereof.

16. The sound insulation electronic pad as defined in claim 15, wherein the decoration comprises a lighting unit set or a light strip formed by at least one LED.

17. The sound insulation electronic pad as defined in claim 16, wherein the decoration is coupled with the electronic sensor.

* * * * *